US005531365A

United States Patent [19]

Donnelly

[11] Patent Number: 5,531,365

[45] Date of Patent: Jul. 2, 1996

[54] BELT CLIP INCORPORATING A MULTIPURPOSE TOOL

[76] Inventor: Michael Donnelly, 504 Borrie Ave., Brielle, N.J. 08730

[21] Appl. No.: 245,661

[22] Filed: May 18, 1994

[51] Int. Cl.[6] ..... A45C 15/00; A45F 4/00

[52] U.S. Cl. ..... 224/576; 224/191; 224/195; 224/197; 224/247; 224/269; 224/232; 224/271; 224/669; 224/682

[58] Field of Search ..... 224/151, 163, 224/185, 191, 195, 197, 247, 252, 253, 269, 232, 271; 24/3 F, 32, 35; 7/118, 160, 167, 108, 165

[56] References Cited

U.S. PATENT DOCUMENTS

| | | | |
|---|---|---|---|
| 3,461,469 | 2/1969 | Morrison | 206/102 |
| 4,384,390 | 5/1983 | Hayakawa | 24/163 |
| 4,529,111 | 7/1985 | Hayakawa | 224/163 |
| 4,741,074 | 5/1988 | Budero, III et al. | 24/35 |
| 4,753,377 | 6/1988 | Poluhowich | 224/163 |
| 4,780,934 | 11/1988 | Vickers et al. | 24/35 |
| 4,881,150 | 11/1989 | Oyamada | 361/392 |
| 4,923,392 | 5/1990 | Hoynihan, III | 431/253 |
| 4,956,895 | 9/1990 | Hayasaka | 24/35 |
| 4,961,239 | 10/1990 | Boyd, Sr. et al. | 7/118 |
| 5,217,150 | 6/1993 | Chen | 224/163 |

*Primary Examiner*—Henry J. Recla
*Assistant Examiner*—Timothy L. Maust
*Attorney, Agent, or Firm*—David C. Hahn

[57] ABSTRACT

A belt clip for securing a device such as a personal communications device, e.g. a paper or radio, to one's belt or clothing includes a tool having tool elements such as a screw driver, knife, bottle cap opener, file, letter opener, cork screw, scissors, etc. The tool itself may include means for securing it directly to the body of the personal communication device. The belt clip may also include a sheath to cover the tool. Alternatively, the sheath may include the means for securing the belt clip to the body of the personal communications device.

15 Claims, 3 Drawing Sheets

FIG. 1
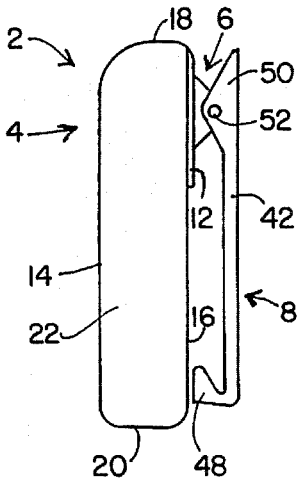
FIG. 2A
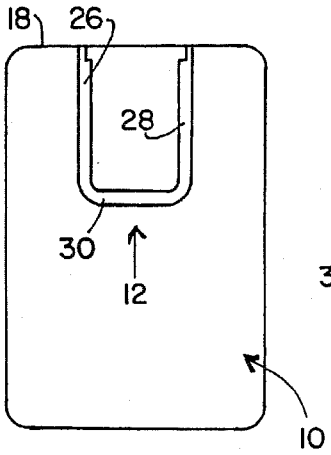
FIG. 3A
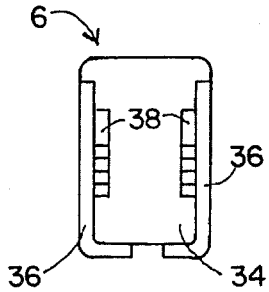
FIG. 3B
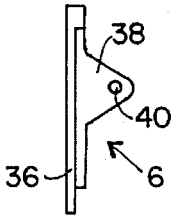
FIG. 2B
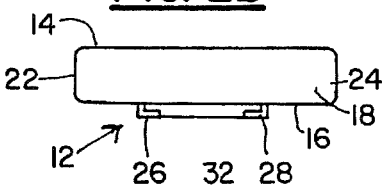
FIG. 4A
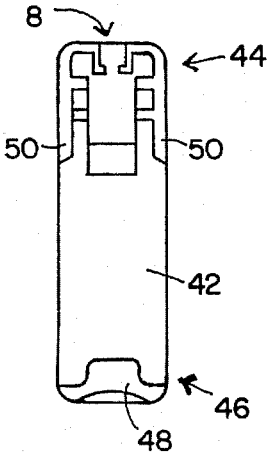
FIG. 4B
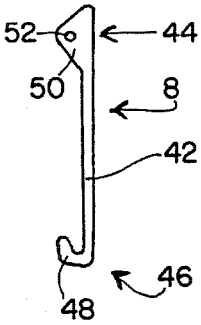
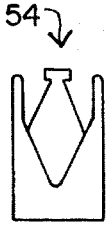
FIG. 5A
FIG. 5B
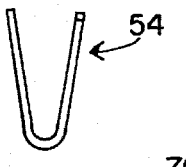
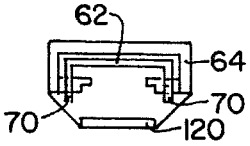
FIG. 6C
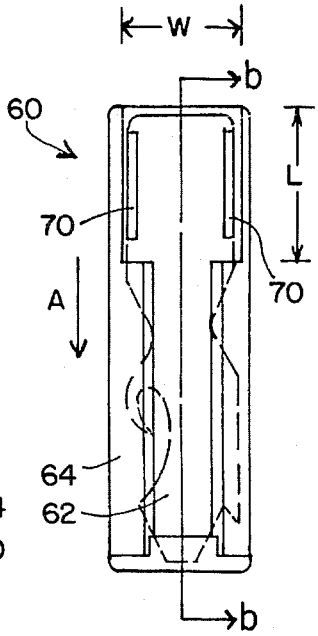
FIG. 6A
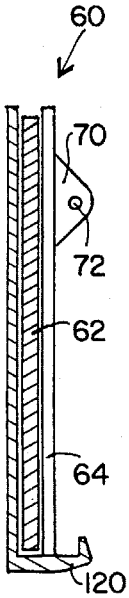
FIG. 6B

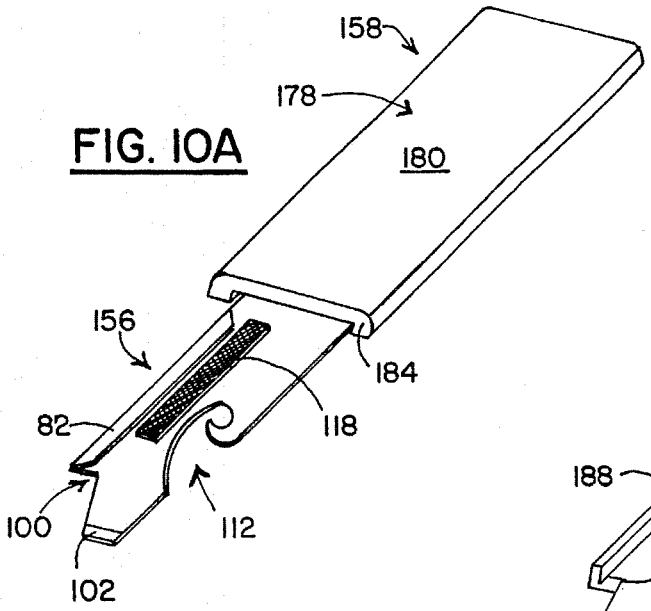
FIG. 10A
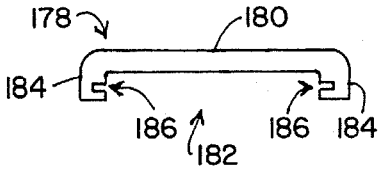
FIG. 10B
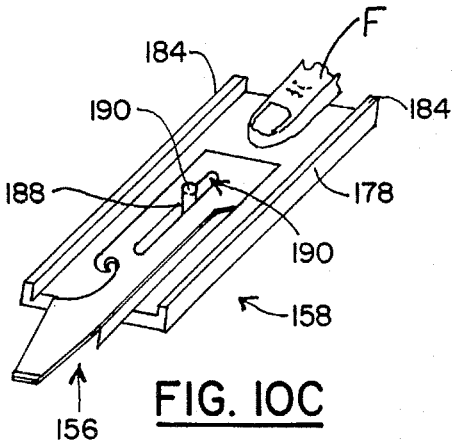
FIG. 10C
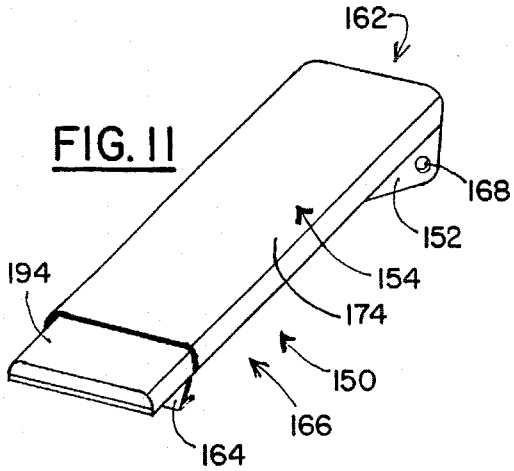
FIG. 11
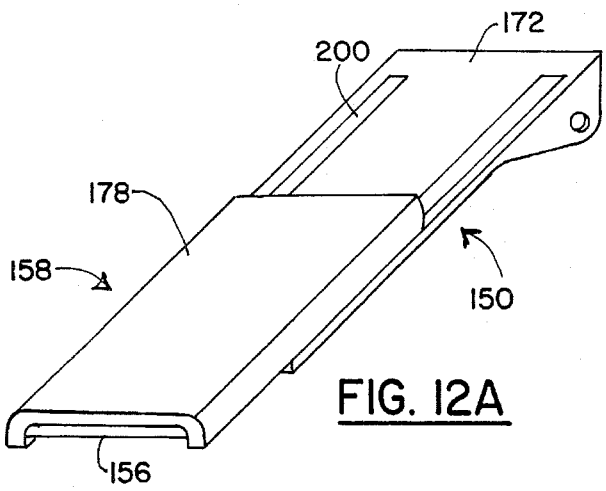
FIG. 12A
FIG. 12B
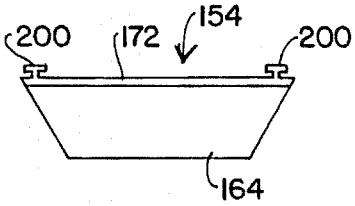
FIG. 12C
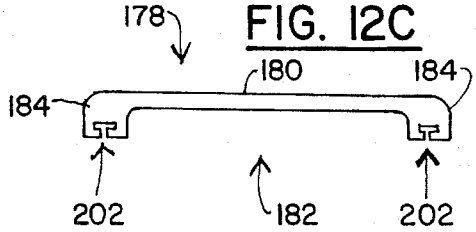

BELT CLIP INCORPORATING A MULTIPURPOSE TOOL

BACKGROUND OF THE INVENTION

1. Field of the Invention

This invention relates to portable devices intended to be carried on one's person. More particularly, this invention relates to clips for such portable devices for securing the device to an article of clothing wherein the clip incorporates a multipurpose tool.

2. Description of the Related Art

Portable devices such as radios and personal communications apparatus, for instance pagers and cellular phones, are in widespread use in our society. These devices provide access to information as well as they allow others to be in contact with the user even when the user is away from a phone. In addition, portable radios are often carried by persons engaged in physical fitness activities to reduce the boredom sometimes associated with such activities. At one time, these devices were large and bulky and not easily carried on one's person. Today, however, the miniaturization of electronics devices has made it commonplace to slip such electronic devices into a pocket or to hang them from a belt or a pocket.

Many clip devices have been designed for securing portable electronic devices to one's person. Examples of such clip devices have been described in U.S. Pat. Nos. 4,741,074 and 4,780,934. Typically, these devices incorporate a bar which is spring loaded and pivotal with respect to the body of the electronics device. The bar may be slipped into a pocket or about a belt thereby securing the electronics device to one's person. Clip mechanisms such as these serve the sole purpose of being able to attach the device to one's person.

A typical personal communications device 2 is best shown in FIG. 1. Personal communications device 2 comprises body 4, adapter 6 and belt clip 8. Body 4, adapter 6 and belt clip 8 are shown in greater detail in FIGS. 2*a*, 2*b*, 3*a*, 3*b*, 4*a* and 4*b*.

Personal communications device body 4 is comprised of box-like housing 10 and adapter interface 12. Housing 10 has front panel 14, back panel 16, upper face 18, bottom face 20 and side panels 22 and 24. Typically, one or more of the aforementioned faces or panels includes an information display such as an LCD or LED display as in todays pagers, or an analog radio frequency display as in many of todays portable radios. One or more of the aforementioned faces or panels may also include buttons or switches for controlling the operation of the personal communications device. Interface 12, as best shown in FIGS. 2*a* and 2*b* , is centered on back panel 16 proximate upper face 18. Interface 12 is comprised of tabs 26, 28 and 30, extending out from back panel 16 in an L-shape thereby forming channel 32, as best shown in FIG. 2*b*, for securing adapter 6 to housing 10. A locking element, not shown in the Figures and as known by those skilled in the art, may be included to prevent adapter 6 from accidentally slipping out from channel 32. Within housing 10 would be contained the electronics necessary for the particular type of personal communications device.

As best shown in FIGS. 3*a* and 3*b*, adapter 6 is a rectangular element including main panel 34 and stepped edge 36 which is thinner than main panel 34. Adapter 6 is secured to housing 10 by sliding stepped edge 36 into engagement with channel 32. Adapter 6 also includes hinge flanges 38 located at each lateral edge for pivotal securement to belt clip 8, as will be discussed in greater detail below. When adapter 6 is secured to housing 10, hinge flanges 38 extend from adapter 6 in the direction away from housing 10. Hinge flanges 38 may be generally triangular in shape, as best shown in FIG. 3*b*, and have hole 40 through which a pin may be pressed in order to pivotally secure belt clip 8 to adapter 6. Those skilled in the art will recognize that hinge flanges 38 may be of any suitable shape including, but not limited to, circular or rectangular. Alternatively, hinge flanges 38 may be integral with housing 10, thereby eliminating the need for adapter 6, tabs 26, 28 and 30, and channel 32, while maintaining the essential function of adapter 6, that being to allow securement and removal of belt clip 8 from housing 10.

Belt clip 8 comprises bar 42 extending longitudinally from upper end 44 to lower end 46. Extending substantially perpendicular to bar 42 from lower end 46 is integral tongue 48. Belt clip 8 also includes hinge flanges 50, similar to hinge flanges 38 of adapter 6, at each lateral edge thereof proximate upper end 44. Hinge flanges 50 extend substantially perpendicularly from bar 42 and in the same direction from bar 42 as does tongue 48. Hinge flanges 50 include holes 52 for passing a round pin therethrough. Hinge flanges 38 and 50 are positioned on adapter 6 and bar 42, respectively, to be separated by different distances so that one set of hinge flanges 38 or 50 fits within the other set of hinge flanges 38 or 50 thereby allowing mating of same.

To secure belt clip 8 to adapter 6, hinge flanges 38 and 50 are aligned so that holes 40 and 52 are aligned thereby allowing a pin, not shown, to be pressed therethrough. Typically, some type of spring clip 54, like that shown in FIGS. 5*a* and 5*b*, or a conventional coil spring, not shown in the Figures, is inserted between belt clip 8 and adapter 6 during assembly to provide sufficient force to bias tongue 48 towards housing 10 to secure personal communications device 2 to one's clothing. As those skilled in the art know, methods exist for securing belt clip 8 to adapter 6 by the use of a clearance-fit pin rather than a press-fit pin.

While the belt clip described above serves the purpose of securing a device to one's person, that belt clip serves that purpose and that purpose alone. It is, therefore, an object of the present invention to provide a belt clip having other uses in addition to securing a device to one's clothing.

SUMMARY OF THE INVENTION

It is an object of the present invention to provide a belt clip for securing a personal communications device to one's person which incorporates a multipurpose tool.

It is a further object of the present invention to provide a belt clip having a multipurpose tool for providing the user with tools including a screw driver, a can or bottle opener, a nail file, a letter opener and a cutting edge in combination with a device commonly carried on one's person.

In general, the invention provides a belt clip for a personal communications device, the device including a first adapter, comprising a first element including a plurality of tools, a second element for carrying the first element, and a second adapter for pivotally securing the first and second elements to the first adapter. The first element includes a plate-like body having first and second surfaces, first and second longitudinally spaced ends and first and second laterally spaced edges, a screw driver blade located along the first end, a cutting edge located along the first edge intermediate the first and second ends, a first recess located along the first edge intermediate the cutting edge and the second end, a bottle cap opener located along the second edge intermediate the first and second ends, a second recess located along the second edge intermediate the bottle cap opener and the second end, and a roughened area located on the first surface proximate the second end. The second adapter may be integral with either the first or the second elements and includes a first and second flanges located along each of the lateral edges of either the first or second element. The flanges are aligned and include a through hole which through holes are aligned.

A belt clip for securing a box-like device to one's person said device including a first adapter, comprising a carrier portion, a tool portion in sliding engagement with the carrier portion and a second adapter wherein the carrier portion comprises a longitudinally extending body having first and second faces and first and second ends, and a tongue extending substantially perpendicularly from the second face adjacent the first end, the tool portion comprising first and second surfaces, the first surface including a roughened portion extending along a portion of the length of the first surface, the tool portion further comprising a screw driver blade, a bottle cap opener, a cutting edge, and a letter opener. A handle may also be incorporated wherein the handle is in sliding engagement with both the carrier portion and the tool portion.

A belt clip for a personal communications device, the personal communications device including a box-like housing having a first panel for displaying information, and a second panel having first adapter means for pivotally securing a spring biased belt clip thereto, the belt clip comprising a plate having first and second ends and first and second faces, a sharp edge for cutting proximate the first end, a screw driver blade located along the first end, a hook for removing bottle caps proximate the first end, and a roughened surface located on the first face proximate the second end, a cover member into which the plate is engaged by sliding, a carrier member to which the cover member is secured, the carrier member having first and second oppositely facing surfaces, first and second ends, and a lip extending substantially perpendicularly from the first surface proximate the first end and a second adapter for pivotally securing the plate, the cover member and the carrier member to the personal communications device, the second adapter including a pair of flanges integral with the carrier member extending substantially perpendicularly from the first surface proximate the second end, the flanges separated by the width of the carrier member and including aligned through holes for inserting a pin therethrough.

BRIEF DESCRIPTION OF THE DRAWINGS

FIG. 1 is a side elevational view of a typical personal communications device including a belt clip.

FIG. 2*a* is a rear elevational view of a personal communications device without the belt clip in place.

FIG. 2*b* is a plan view of the typical personal communications device shown in FIG. 2*a*.

FIG. 3*a* is an elevational view of a personal communications device housing to belt clip adapter.

FIG. 3*b* is a side elevational view of the adapter of FIG. 3*a*.

FIG. 4*a* is an elevational view of a typical belt clip.

FIG. 4*b* is a side elevational view of the belt clip of FIG. 4*a*.

FIG. 5*a* is an elevational view of a spring clip.

FIG. 5*b* is a side elevational view of the spring clip of FIG. 5*a*.

FIG. 6*a* is an elevational view of the belt clip sheath of the present invention with the multipurpose tool of the present invention inside the sheath.

FIG. 6*b* is a sectional view of the belt clip sheath taken along the line b—b of FIG. 6*a*.

FIG. 6*c* is a plan view of the belt clip sheath and multipurpose tool of FIG. 6*a*.

FIG. 10*a* is a perspective view of the handled tool of the present invention.

FIG. 10*b* is an end view of the handle of FIG. 10*a*.

FIG. 10*c* is a perspective view of the handled tool of the present invention.

FIG. 11 is a perspective view of the belt clip with handled tool of FIG. 9*a*.

FIG. 12*a* is a perspective view of another embodiment of the belt clip of the present invention.

FIG. 12*b* is an end view of the carrier portion of the belt clip depicted in FIG. 12*a*.

FIG. 12*c* is an end view of the handle portion of the belt clip depicted in FIG. 12*a*.

DESCRIPTION OF THE INVENTION

One embodiment of belt clip 60 of the present invention is best shown in FIGS. 6*a*, 6*b* and 6*c*. Belt clip 60 is comprised of multipurpose tool 62 and may also include sheath 64. Multipurpose tool 62 may be manufactured by machining and/or stamping processes well known to those skilled in the art, and is preferably made from stainless steel. Multipurpose tool 62 may also include a chrome plated finish. Other materials and forming processes known to those skilled in the art, may be employed with equal advantage.

Figure 7A:
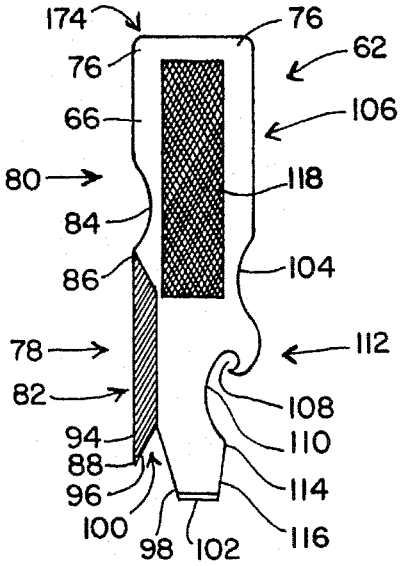
FIG. 7*a* is an elevational view of the multipurpose tool of the present invention.
Figure 7B:
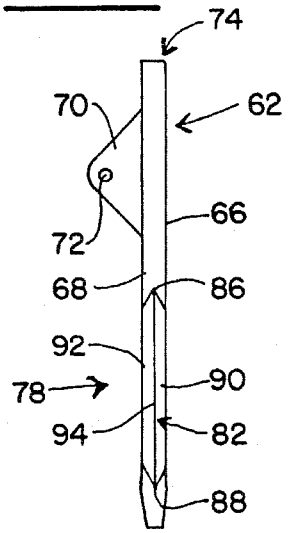
FIG. 7*b* is a side elevational view of the multipurpose tool shown in FIG. 7*a*.
Figure 7C:
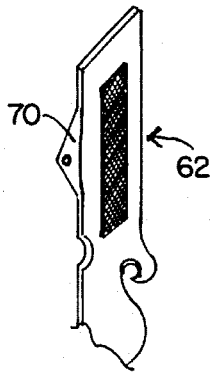
FIG. 7*c* is partial perspective view of the multipurpose tool shown in FIG. 7*a* and 7*b*.

As best shown in FIGS. 7*a*, 7*b* and 7*c*, multipurpose tool 62 is generally flat and rectangular. Front face 66 is substantially flat while rear face 68 includes hinge flanges 70 having hole 72 for mating with an adapter like adapter 6 described above. Top end 74 may have essentially square or 90° corners 76 while bottom end 78 includes several tool elements. As viewed in FIG. 7*a*, left hand side 80 includes knife 82 and gripping recess 84. Knife 82 extends from a point 86 near the middle of left hand side 80 to terminus 88 adjacent bottom end 78. As best shown in the side view of FIG. 7*b*, knife 82 includes tapered from and rear surfaces 90 and 92, respectively. Tapered surfaces 90 and 92 converge to form cutting edge 94. Gripping recess 84 is a concave curved area allowing the user to better grip multipurpose tool 62 during use.

Referring again to FIG. *7a*, from terminus 88 of knife 82, left hand side 80 is cut at an acute angle up along edge 96 towards top end 74 and then back down along edge 98 towards bottom end 78 forming a V-shaped notch 100. Notch 100 may be used as a letter opener. Edge 98 extends along a taper towards bottom end 78 and the mid-point of front face 66, terminating at bottom end 78 to thereby form screw driver blade 102.

A second gripping recess 104 is located near the mid-point of right hand side 106. Just below second gripping recess 104 is hook 108 and curved recess 110 which together form bottle cap opener 112. Curved recess 110 has a lower terminus point 114 from which extends edge 116. Edge 116 is tapered in towards the middle of front surface 66 terminating at screw driver blade 102.

Front surface 66 may also include roughened or knurled section 118. One use for roughened section 118 is as a nail file, but might also be utilized, in a pinch, as a file for wood or metal surfaces.

As best shown in FIGS. *7b* and *7c*, hinge flanges 70 extend from back surface 68 along both right hand side 106 and left hand side 80, adjacent top end 74. Hinge flanges 70 are positioned to fit either inside or outside of adapter hinge flanges 38, for mating, as described above. Positioning hinge flanges 70 on the surface opposite from the surface including roughened section 118 provides easy access to roughened section 118. Roughened section 118 may, therefore, be utilized without disassembling belt clip 60 from housing 10.

Tool 62 is secured to adapter 6, as described, by aligning hinge flanges 38 and 70 and holes 40 and 72, and then pressing a pin therethrough. In order to provide the pressure necessary to secure a personal communications device to an article of clothing, spring clip 54 like that shown in FIGS. *5a* and *5b*, or a coil spring, not shown in the Figures, may be inserted between belt clip 60 and adapter 6 during assembly. Spring 54 biases bottom end 78 towards the personal communications device thereby providing the pressure required to secure the personal communications device to an article of clothing.

An optional element of belt clip 60 is sheath 64, as shown in FIGS. *6a*, *6b*, *6c*, *8a*, *8b*, and *8c*. Sheath 64 may be used to help protect one's person and clothing from injury or damage which would be caused if the sharp edges and/or hook of multipurpose tool 62 were to catch one's person or clothing. As shown in FIG. *6a*, multipurpose tool 62 is shown partly in phantom where it is covered by sheath 64. In FIGS. *6b* and *6c*, hinge flanges 70 can be seen to extend in the same direction as tongue 120.

Sheath 64 is, preferably, formed by injection molding using a plastic material but may be formed from any number of well known materials and by any number of suitable manufacturing methods. As best shown in FIGS. *8b* and *8c*, sheath 64 is a box-like structure having a hollow interior section 122. Sheath 64 has a solid from face 124 as well as solid sides 126 and 128. Back 130 is characterized by upper opening 132. As best shown in FIGS. *6a* and *6c*, upper opening 132 has the same or slightly larger width W as the width of multipurpose tool 62 and a length L long enough for hinge flanges 70 to extend out towards and be secured to adapter 6. Referring again to FIGS. *8a*, *8b* and *8c*, lower portion 134 of sheath 64 may be a solid surface or may have an opening 136 which is narrower than upper opening 132. A narrower width provides tabs 138 for holding multipurpose tool 62 in place. Top end 140 is also open so that sheath 64 can slide to allow insertion and removal of multipurpose tool 62. Bottom end 142 is closed and includes integral tongue 120. Sheath 64 is preferably slid over multipurpose tool 62 so that tongue 120 and hinge flanges 70 extend in the same direction, i.e. towards housing 10.

Sheath 64 can be slid over multipurpose tool 62 covering knife 82 and hook 108, thereby preventing damage to one's clothing. When one wants to use multipurpose tool 62, one would simply slide sheath 64 in the direction of arrow A, exposing the multipurpose tool 62. Multipurpose tool 62 could then be utilized while attached to personal communications device 2 or multipurpose tool 62 could be disassembled from personal communications device 2 before use.

While multipurpose tool 62 has been described as incorporating a screw-driver blade, a bottle cap opener, a knife, a letter opener and a nail file, these elements have been mentioned by way of example and are not to be construed as limitations. Other tools, such as a pen or other writing instrument, cork screw, scissors, etc., may also be developed and incorporated into the tool within the contemplation of the present invention.

Figure 8A:
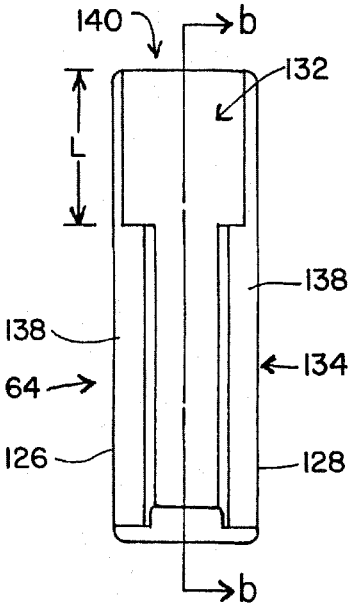
FIG. 8*a* is an elevational view of the sheath of the present invention.
Figure 8B:
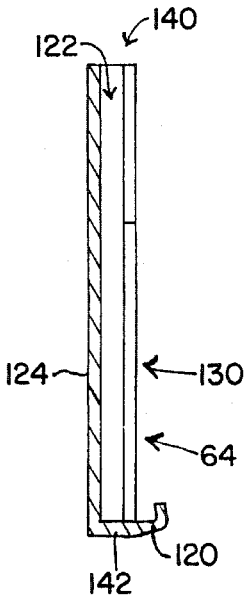
FIG. 8*b* is a sectional view of the sheath taken along the line b—b of FIG. 8*a*.
Figure 8C:
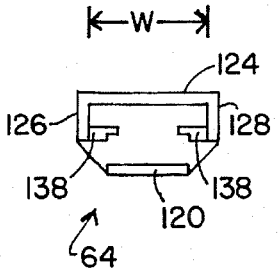
FIG. 8*c* is a plan view of the sheath of FIGS. 8*a* and 8*b*.
Figure 9A:
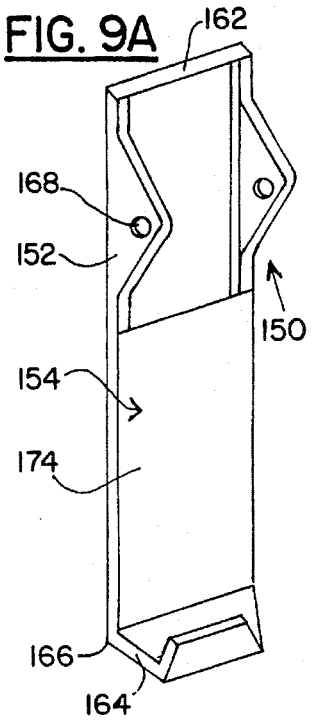
FIG. 9*a* is a perspective view of another embodiment of the belt clip of the present invention.
Figure 9B:
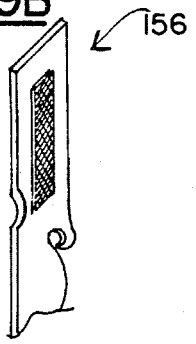
FIG. 9*b* is a partial perspective view of the multipurpose tool of the present invention.
Figure 9C:
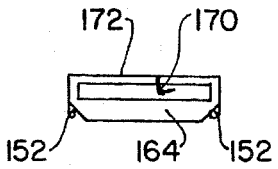
FIG. 9*c* is an end view of the belt clip of FIG. 9*a*.

Another embodiment of the present invention is best shown in FIGS. 9, 10 and 11. The primary difference between belt clip 150, best shown in FIG. *9a*, and belt clip 60 shown in FIGS. 6, 7, and 8, is that hinge flanges 152 are integral with body 154 rather than tool 156, as shown in FIG. *9b*. Belt clip 150 presents several advantages over belt clip 60. Access is now provided for the use of tool 156 without it being attached to housing 10 or without having to detach tool 156 from housing 10. In addition, handled tool 158, as shown in FIG. *10a*, may now also be employed. Handled tool 158 provides protection to the user from the sharp edges of the tool during use, and also provides additional leverage during use.

As best shown in FIG. *9a*, belt clip 150 includes body 154 having integral hinge flanges 152 extending therefrom proximate top end 162 and tongue 164 extending therefrom proximate lower end 166. As can be seen in FIG. *9a*, hinge flanges 152 and tongue 164 extend in substantially the same direction from and substantially perpendicularly to body 154. Each of hinge flanges 152 are of substantially triangular shape and have through holes 168 which are aligned for mating to adapter 6, as has been described previously. Again, hinge flanges 152 may be of any suitable shape for pivotally mating belt clip 150 to adapter 6.

Body 154 may be hollow to allow sliding engagement of tool 156 or handled tool 158, therein. As best shown in FIGS. *9c* and 11, body 154 may have opening 170 at lower end 166 for inserting tool 156 or handled tool 158, however, those skilled in the art will recognize that insertion could be through an opening at top end 162, just as well. Body 160 has solid front and back surfaces 172 and 174, as well as solid sides 176. While either one of top end 162 or lower end 166 are open, the other is closed allowing tool 156 or handled tool 158 to be inserted and removed from only one end of belt clip 150.

As best shown in FIGS. *10a* and *10c*, handled tool 158 includes tool 156 and handle 178. Tool 156 is again substantially the same as tool 62, it includes screw driver blade 102, knife 82, notch 100, bottle cap opener 112 and roughened section 118. Tool 156 is preferably made from a metal such as stainless steel, and may be manufactured by machining or stamping processes well known to those skilled in the art. Handle 178 is preferably made from a plastic type material and may be machined but is preferably made by injection molding.

Tool 156 and handle 178 are mated in sliding engagement. As shown in FIG. 10*b*, handle 178 has a first surface 180 which is solid and an open side 182. Extending from open side 182 are track legs 184. Track legs 184 may include grooves 186, as best shown in FIG. 10*b*, in which tool 156 slides. As an alternative to grooves 186, handle 178 may include post 188, best shown in FIG. 10*c*, extending from open side 182. Post 188 would fit into slot 190 in tool 156 and would have headed end 192 to maintain engagement with tool 156.

When fully retracted, tool 156 is fully covered by handle 178, i.e. no portion of tool 156 extends out past the edges of handle 178. When not using the tools of tool 156, and while in the fully retracted position, handled tool 158 would be slid into opening 170 of body 160. Body 160 and handled tool 158 are sized so that end 194 of handled tool 158 remains exposed thereby allowing the user to grip handled tool 158 to remove it from body 160. To utilize tool 156, the user would remove handled tool 158 from body 160 by sliding it out therefrom, and would then expose the tool elements, i.e. screw driver, knife, file, etc., by pushing tool 156 with a finger F as illustrated in FIG. 10*c*.

In a variation of belt clip 150, described above, body 154 operates as a carrier for handled tool 158. As best shown in FIG. 12*a*, handled tool 158 slides onto, not into, body 154. Instead of body 154 being hollow, front face 172, as shown in FIGS. 12*a* and 12*b*, includes rails such as T-rails 200 with which handled tool 158 is engaged by sliding. In order to allow mating of handled tool 158 body 154, handle 178 includes slots such as T-slots 202, as shown in FIG. 12*c*. Alternatively, those skilled in the art will recognize handle 178 and front face 172 could be outfitted so that handle 178 could be snapped in place, rather than slid. The embodiment of belt clip 150, as best shown in FIGS. 12*a*, 12*b* and 12*c*, provides a safe, slim and convenient belt clip incorporating a multipurpose tool.

While the invention has been described as having a preferred design, it is understood that it is capable of further modifications, uses and or adaptations, following the general principle of the invention and including such departures from the disclosed invention as are known or customary in the art to which the invention pertains, and as may be applied to the features set forth above, and fall within the scope of the invention and the appended claims.

What I claim is:

1. A clip for securing a personal communications portable device having a first adapter to an article carrier, said clip comprising:

a. plate-shaped first element including one or more tools;

b. a second element having first and second ends for carrying said first element; and c. a second adapter for pivotally securing said first and second elements to the first adapter;

i. said second adapter comprising a pair of parallel flanges extending in a direction substantially perpendicular to one face of said first element, said flanges located proximate said first end of said second element; and d. means for biasing said second end of said second element toward the portable device wherein the article carrier is maintained between the clip and the portable device.

2. The clip of claim 1, wherein said one or more tools includes a screw driver blade, a bottle cap opener, a knife and a nail file.

3. The clip of claim 2, wherein said first element comprises:

a. a plate-shaped body having first and second surfaces, first and second longitudinally spaced ends and first and second laterally spaced edges;

b. a screw driver blade located along said first end;

c. a cutting edge located along said first edge intermediate said first and second ends;

d. a first recess located along said first edge intermediate said cutting edge and said second end;

e. a bottle cap opener located along said second edge intermediate said first and second ends;

f. a second recess located along said second edge intermediate said bottle cap opener and said second end; and g. a roughened area located on said first surface proximate said second end.

4. The clip of claim 3, wherein said second adapter is integral with said first element.

5. The clip of claim 3, wherein said second element comprises a longitudinally extending body having first and second faces, first and second ends, first and second edges and an integral tongue extending from said first face proximate said first end, wherein said second adapter is integral with said second element, said second adapter including a first flange located along said first edge proximate said second end and extending substantially perpendicularly from said first face and a second flange aligned with said first flange located along said second edge proximate said second end and extending substantially perpendicularly from said first face, each of said first and second flanges including a through hole said through holes being aligned.

6. The clip of claim 5, wherein said body is hollow and wherein said first element is engaged within said hollow body by sliding.

7. The clip of claim 3, further comprising a handle in sliding engagement with said both said first and second elements.

8. The clip of claim 7, wherein said second element comprises a hollow body into which said handle is engaged by sliding.

9. The clip of claim 7, wherein said second element comprises a longitudinally extending body having first and second surfaces said first surface including said second adapter and said second surface including means for securing said handle thereto.

10. A belt clip for securing a box-shaped device having a first adapter to one's person, said belt clip comprising:

a. a carrier portion;

b. a plate-shaped tool portion in sliding engagement with said carrier portion; and a second adapter, including means for pivotally securing said belt clip to said first adapter;

d. said carrier portion comprising a longitudinally extending body having first and second faces and first and second ends, and a tongue extending substantially perpendicularly from said second face adjacent said first end;

e. said tool portion comprising first and second surfaces, said first surface including a roughened portion extending along a portion of the length of said first surface;

f. said pivoting means including a pair of parallel flanges extending in a direction substantially perpendicular to said second face of said carrier portion, said flanges located proximate said second end of said carrier portion;

g. said tool portion further comprising a screw driver blade, a bottle cap opener, a cutting edge, and a letter opener.

11. The belt clip of claim 10, wherein said second adapter includes first and second flanges located along opposed edges of said carrier portion proximate said second end and extending substantially perpendicularly from said first face.

12. The belt clip of claim 11, further comprising a handle removeably engaged with said carrier portion.

13. The belt clip of claim 12, wherein said tool portion is secured to said handle and is in sliding engagement therewith.

14. The belt clip of claim 13 wherein said carrier portion includes first and second rails extending substantially perpendicularly from said second face and running longitudinally along said body, said first rail proximate said first edge and said second rail proximate said second edge and wherein said handle includes first and second rail slots for sliding along said first and second rails.

15. A belt clip for a personal communications device, said personal communications device including a box-shaped housing having a first panel for displaying information, and a second panel having first adapter means for pivotally securing a spring biased belt clip thereto, said belt clip comprising:

a. a plate having first and second ends and first and second faces, a sharp edge for cutting proximate said first end, a screw driver blade located along said first end, a hook for removing bottle caps proximate said first end, and a roughened surface located on said first face proximate said second end;

b. a cover member into which said plate is engaged by sliding;

c. a carrier member to which said cover member is secured, said carrier member having first and second oppositely facing surfaces, first and second ends, and a lip extending substantially perpendicularly from said first surface proximate said first end; and d. a second adapter for pivotally securing said plate, said cover member and said carrier member to said personal communications device, said second adapter including a pair of flanges integral with said carrier member extending substantially perpendicularly from said first surface proximate said second end, said flanges separated by the width of said carrier member and including aligned through holes for inserting a pin therethrough.

* * * * *